US007300568B2

(12) United States Patent
Ketley et al.

(10) Patent No.: US 7,300,568 B2
(45) Date of Patent: Nov. 27, 2007

(54) METHOD OF MANUFACTURING OXYGENATED FUEL

(75) Inventors: Graham W. Ketley, Farnham (GB); Michael Hodges, Wonersh (GB); Janet L. Yedinak, Westmont, IL (US)

(73) Assignee: BP Corporation North America Inc., Warrenville, IL (US)

( * ) Notice: Subject to any disclaimer, the term of this patent is extended or adjusted under 35 U.S.C. 154(b) by 508 days.

(21) Appl. No.: 10/718,946

(22) Filed: Nov. 21, 2003

(65) Prior Publication Data

US 2005/0109671 A1 May 26, 2005

(51) Int. Cl.
*C10G 27/04* (2006.01)

(52) U.S. Cl. ..... 208/299; 208/3; 208/240; 208/231; 208/263

(58) Field of Classification Search ..... 208/3, 208/240, 231, 299
See application file for complete search history.

(56) References Cited

U.S. PATENT DOCUMENTS

| | | | | |
|---|---|---|---|---|
| 2,300,691 | A | 11/1942 | Ocon | 196/50 |
| 4,494,961 | A | 1/1985 | Venkat et al. | 44/57 |
| 5,637,259 | A * | 6/1997 | Galuszka et al. | 252/373 |
| 2003/0010674 | A1 | 1/2003 | Hagen et al. | 208/3 |

FOREIGN PATENT DOCUMENTS

| | | |
|---|---|---|
| EP | 0226258 | 6/1987 |
| EP | 0252606 | 1/1988 |
| WO | 0132809 | 5/2001 |

* cited by examiner

*Primary Examiner*—Tam M. Nguyen
(74) *Attorney, Agent, or Firm*—Ekkehard Schoettle; Karin Peterka

(57) ABSTRACT

Disclosed is a process to improve the cetane number and emissions characteristics of a distillate feedstock by increasing the oxygen content of the feedstock by contacting the feedstock with an oxygen-containing gas in the oxidation zone at oxidation conditions in the presence of an oxidation catalyst comprising a Group VIII metal and a basic support.

4 Claims, 3 Drawing Sheets

METHOD OF MANUFACTURING OXYGENATED FUEL

BACKGROUND OF THE INVENTION

The present invention relates to a method of improving middle distillate fuels. More specifically the present invention relates to a method of selectively incorporating oxygen into diesel fuels in order to improve emissions characteristics by reducing the level of particulates and/or increasing the cetane number of the diesel. Improving cetane number of a diesel fuel results in improved ignition characteristics such as improved cold weather starting, reduction in ignition delays, combustion noise and misfiring.

Previous approaches to improving the cetane number of diesel fuel have included blending with higher cetane value streams, hydrotreating and/or the addition of cetane enhancing additives. These approaches suffer from cost/availability issues for hydrogen and the cetane enhancing additives. A desirable approach would be to carry out a heterogeneous catalytic process that results in the selective oxygenation of the fuel without the addition of expensive chemical oxidizing agents such as organic peroxides, ozone or hydrogen peroxide.

In this connection U.S. Pat. No. 4,723,963 (Taylor) discloses a middle distillate hydrocarbon fuel comprising at least 3 weight percent oxygen. Taylor teaches the selective oxygenation of hydroaromatic and aromatic compounds by passing oxygen and/or air through the compounds or by the use of chemical oxygen donor compounds or by reacting the compounds to form halides followed by the hydrolysis to form the alcohol or dehydrogenating the compounds to form olefins and reacting the olefinic aromatics with water, or with carbon monoxide and hydrogen. This oxygenated stream can then be blended with a paraffinic rich stream.

WO 01/32809 discloses another process for selectively oxidizing distillate fuel or middle distillates. The subject reference discloses that oxidized distillate fuels wherein hydroxyl and or carbonyl groups are chemically bound to paraffinic molecules in the fuel results in a reduction of particulates generated upon combustion of the fuel versus unoxidized fuel. The reference discloses a process for selectively oxidizing saturated aliphatic or cyclic compounds in the fuel with peroxides, ozone or hydrogen peroxide such that hydroxyl or carbonyl groups are formed in the presence of various titanium containing silicon based zeolites.

U.S. Pat. No. 4,494,961 (Venkat et al.) discloses a method of increasing the cetane number of a low hydrogen content highly aromatic distillate fuel by subjecting it to catalytic partial oxidation. The subject method involves heating the aromatic diesel fuel under mild oxidation conditions in the presence of a catalyst system comprising (1) an alkaline earth metal permanganate, (2) an oxide of a metal of Groups IB, IIB, IIIB, IVB, VB, VIB, VIIB, or VIII of the Periodic Table, or (3) a mixture of (2) and an alkali metal or alkaline earth metal oxide or salt.

An earlier effort to improve diesel fuel combustion characteristics by attaining minimum engine knocking i.e., the time interval between the instant of liquid fuel injection and the instant of ignition, is disclosed in U.S. Pat. No. 2,521,698 (Denison, Jr. et al.) The subject reference discloses a process that involves partial oxygenating of distillate by contact with an oxygen-containing gas whereby the fuel's cetane number is increased while not increasing the conversion to compounds that produce corrosion.

European Patent Application 0 293 069 discloses a fuel production process whereby the cetane number is improved by hydrogenating a naphthalene or alkylnaphthalene hydrocarbon oil to tetralin and partially oxidizing the hydrogenated oil to yield a hydrocarbon oil containing tetralin hydroperoxide. The partial oxidation is carried out by placing the oil under oxygen under pressure of 3 to 8 kg/cm2 at a temperature of 60 to 100 C. for a period of 3 to 10 hours or by adding a copper or nickel catalyst to the oil.

As is evident from the above discussion that what is needed is a process for increasing the cetane number of a distillate fuel via a direct oxygen incorporation from air or another suitable oxygen-containing gas without the addition of expensive chemical oxidizing agents or the time intensive, hence capital intensive contact periods while concomitantly not increasing corrosion by increasing the TAN acidity of the fuel.

The process of the present invention provides a relatively simple process for incorporating oxygen into middle distillate or diesel range hydrocarbon feedstocks by contacting the feedstock with an oxygen-containing gas in the presence of a heterogeneous catalyst comprising a Group VIII metal on a basic support.

SUMMARY OF THE INVENTION

The process of the present invention involves improving the cetane number and emissions characteristics of a distillate feedstock by contacting the feedstock with an oxygen-containing gas in an oxidation zone at oxidation conditions in the presence of an oxidation catalyst comprising a Group VIII metal and a basic support.

DESCRIPTION OF THE PREFERRED EMBODIMENT(S)

Figure 1:
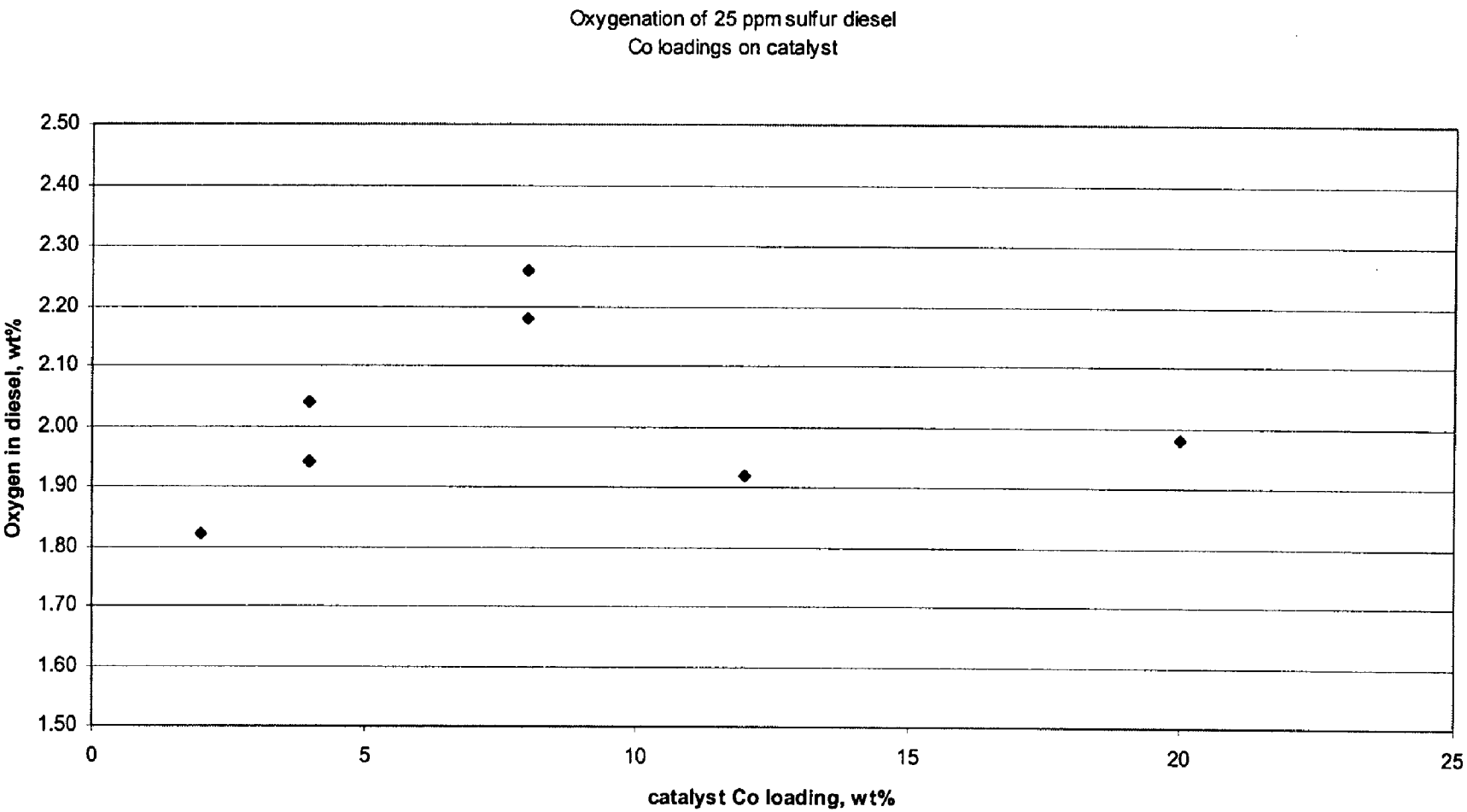
FIG. 1 is a graph that shows the relationship between the amount of oxygen incorporated into a middle distillate effluent which has been subjected to a process in accordance with the present invention as a function of cobalt loading on the oxidation catalyst.

The hydrocarbon feedstock suitable for use with the present invention generally comprises a substantial portion of a distillate hydrocarbon feedstock, wherein a "substantial portion" is defined as, for purposes of the present invention, at least 50% of the total feedstock by volume. The distillate hydrocarbon feedstock processed in the present invention may be of any one, several, or all refinery streams boiling in a range from about 50° C. to about 425° C., preferably from about 150° C. to about 400° C., and more preferably between about 175° C. to about 375° C. at atmospheric pressure. These streams include, but are not limited to, virgin light middle distillate, virgin heavy middle distillate, fluid catalytic cracking process light catalytic cycle oil, coker still distillate, hydrocracker distillate, and the collective and individually hydrotreated embodiments of these streams. Other refinery streams amenable for use in this invention are the collective and individually hydrotreated embodiments of fluid catalytic cracking process light catalytic cycle oil, coker still distillate, and hydrocracker distillate.

It is also anticipated that one or more of the above distillate streams can be combined for use as feedstock to the process of the invention. In many cases performance of the refinery transportation fuel or blending components for refinery transportation fuel obtained from the various alternative feedstocks may be comparable. In these cases, logistics such as the volume availability of a stream, location of the nearest connection and short-term economics may be determinative as to what stream is utilized. The lighter hydrocarbon components in the distillate product are generally more profitably recovered to gasoline and the presence of these lower boiling materials in distillate fuels is often constrained by distillate fuel flash point specifications. Heavier hydrocarbon components boiling above 700° F. 375° C. are generally more profitably processed as fluidized catalytic cracking process ("FCC") feed and converted to gasoline. The presence of heavy hydrocarbon components in distillate fuels is further constrained by distillate fuel end point specifications.

The distillate hydrocarbon feedstock can comprise high and low sulfur virgin distillates derived from high- and low-sulfur crudes, coker distillates, catalytic cracker light and heavy catalytic cycle oils, and distillate boiling range products from hydrocracker and resid hydrotreater facilities. Generally, coker distillate and the light and heavy catalytic cycle oils are the most highly aromatic feedstock components, ranging as high as 80% by weight. The majority of coker distillate and cycle oil aromatics are present as monoaromatics and di-aromatics with a smaller portion present as tri-aromatics. Virgin stocks such as high and low sulfur virgin distillates are lower in aromatics content typically ranging as high as 35% by weight aromatics. Generally, the aromatics content of a combined feedstock will range from about 5% by weight to about 80% by weight, more typically from about 10% by weight to about 70% by weight, and most typically from about 20% by weight to about 60% by weight.

The distillate hydrocarbon feedstock sulfur concentration is generally a function of the high and low sulfur crude mix, the hydrodesulfurization capacity of a refinery per barrel of crude capacity, and the alternative dispositions of distillate hydrodesulfurization feedstock components. The higher sulfur distillate feedstock components are generally virgin distillates derived from high sulfur crude, coker distillates, and catalytic cycle oils from fluid catalytic cracking units processing relatively higher sulfur feedstocks. These distillate feedstock components can range as high as 2% by weight elemental sulfur but generally range from about 0.1% by weight to about 0.9% by weight elemental sulfur.

The distillate hydrocarbon feedstock nitrogen content is also generally a function of the nitrogen content of the crude oil, the hydrodesulfurization capacity of a refinery per barrel of crude capacity, and the alternative dispositions of distillate hydrodesulfurization feedstock components. The higher nitrogen distillate feedstocks are generally coker distillate and the catalytic cycle oils. These distillate feedstock components typically have total nitrogen concentrations ranging as high as 2,000 ppm, but generally range from about 1 ppm to about 900 ppm.

In accordance with the oxidation process of the present invention, the distillate feedstock is contacted with an oxygen-containing gas in an oxidation zone. Those skilled in the art readily recognize certain oxygen-containing compositions depending upon specific feedstock composition, pressure and temperature, are explosive and the composition of an oxygen containing stream should be selected to avoid explosive regions. Because oxygen depleted air can be used in the present invention the concentration can be less than about 21 vol %. In any event the oxygen-containing stream should have an oxygen content of at least 0.01 vol. %. The gases can be supplied from air and inert diluents such as nitrogen if required. The oxygen-containing gas can be circulated in amounts ranging from 200 to 20,000 Standard Cubic Feet per Barrel of distillate feedstock.

The pressure in the oxidation zone can range from ambient to 3000 psig and preferably from about 100 psig to about 400 psig, more preferably from about 150 psig to about 300 psig and most preferably from 200 psig to 300 psig.

The temperature in the oxidation zone can range from about 150° F. to about 500° F., preferably from about 200° F. to about 450° F. and most preferably from about 250° F. to about 350° F.

The oxidation process of the present invention operates at a liquid hourly space velocity of from about 0.1 $hr^{-1}$ to about 100 $hr^{31\ 1}$, preferably from about 0.2 $hr^{-1}$ to about 50 $hr^{-1}$, and most preferably from about 0.5 $hr^{-1}$ to about 10 $hr^{-1}$ for best results. Excessively high space velocities will result in reduced overall oxidation.

Generally, the oxidation process of the present invention begins with a distillate feedstock preheating step. The distillate feedstock is preheated in feed/effluent heat exchangers prior to entering a furnace for final preheating to a targeted reaction zone inlet temperature. The distillate feedstock can be contacted with an oxygen-containing stream prior to, during, and/or after preheating.

Since the oxidation reaction is generally exothermic, interstage cooling, consisting of heat transfer devices between fixed bed reactors or between catalyst beds in the same reactor shell, can be employed. At least a portion of the heat generated from the oxidation process can often be profitably recovered for use in the oxidation process. Where this heat recovery option is not available, cooling may be performed through cooling utilities such as cooling water or air, or through the use of a quench stream injected directly into the reactors. Two-stage processes can provide reduced temperature exotherm per reactor shell and provide better oxidation reactor temperature control.

The reaction zone effluent is generally cooled and the effluent stream is directed to a separator device to remove the oxygen-containing gas which can be recycled back to the process. The oxygen-containing gas purge rate is often controlled to maintain a minimum or maximum oxygen content in the gas passed to the reaction zone. Recycled oxygen-containing gas is generally compressed, supplemented if required, with "make-up" oxygen or oxygen-containing gas (preferably air), and injected into the process for further oxidation.

The process of the present invention can be carried out in any sort of gas-liquid-solid reaction zone known to those skilled in the art. For instance, the reaction zone can consist of one or more fixed bed reactors. A fixed bed reactor can also comprise a plurality of catalyst beds. Additionally the reaction zone can be a fluid bed reactor, slurry, or trickle bed reactor. The simplification implied by the use of a heterogeneous catalyst would facilitate a range of less conventional applications for the process of the present invention. For instance it is contemplated that the process of the invention can be carried out on skid-mounted units at terminals or pipelines, garage forecourts and on-board fuels cell containing vehicles where hydrocarbon reformers and fuels cells are employed.

The oxidation catalysts used in the present invention comprise a Group VIII metal component and a basic catalyst support. The preferred Group VIII metals suitable for use in the present invention include iron, cobalt, nickel, ruthenium, rhodium, palladium, osmium, iridium, and platinum. The most preferred Group VIII metal is cobalt. These metals can be present in their elemental form or as oxides, or mixtures thereof. The metals are present in an amount ranging from about 0.1 wt % to about 50 wt. % based on the total catalyst weight, preferably from about 2 wt % to about 20 wt % and most preferably from about 4 wt % to about 12 wt %.

The support component of the catalyst used in the process of the present invention is a basic support. Alkali oxides and alkaline earth oxides are the preferred supports, with MgO and CaO being most preferred.

The catalyst used in accordance with the present invention can be prepared by any of the standard methods of preparation known to those skilled in the art such as the precipitation method and the impregnation method.

Group VIII component metals can be deposed or incorporated upon the support by impregnation employing heat-decomposable salts of the Group VIII metals or other methods known to those skilled in the art such as ion-exchange, with impregnation methods being preferred. Suitable aqueous impregnation solutions include, but are not limited to cobalt nitrate, and nickel nitrate. Other impregnating solutions could include aqueous solutions of either metal oxalate, formate, propionate, acetate, chloride, carbonate or bicarbonate. Alternatively the solution may be organic when used with metal compounds that are soluble in organic solvents e.g. metal acetylacetonates or metal naphthenates.

The process of the present invention permits the production of diesel fuel containing at least about 0.02 wt % oxygen, preferably about 0.2 wt % oxygen to about 20 wt % oxygen. and most preferably about 1.8 wt % to about 10 wt % oxygen. Most importantly, the oxygen containing species of the present invention, do not result in a distillate having a high TAN number. TAN number is defined as mg KOH per gram hydrocarbon sample required to neutralize any acids in the hydrocarbon sample. The TAN numbers of products made in accordance with the present invention are less than about 2.0, preferably less than about 1.0, and most preferably less than about 0.5. If the fuel is over oxidized to a TAN number above these levels then it may be necessary to remove acids via conventional methods known to those skilled in the art such as caustic washing.

EXAMPLE 1

FIG. 1 depicts a curve based on various runs carried out with a middle distillate feedstock in accordance with the present invention. The runs were carried out in a batch reactor at 200 psig, 900 rpm and 310° F. The reactor used was a stirred, heated, 300 $cm^3$ volume autoclave available from Autoclave Engineers having internal cooling coils and a means for continuous gas feed.

The oxidizing gas had a composition of 7 vol. % $O_2$ in $N_2$ and the gas was passed to the reactor at a rate of 400 standard cubic centimeters per minute. The reaction time was 5 hours.

The middle distillate feed used in the runs depicted in FIG. 1 had the following composition:

TABLE I

| Distillate Feed Composition | |
|---|---|
| **Analytical Tests** | |
| Oxygen (wt %)) | 0.10 |
| Carbon (wt %) | 87.02 |
| Hydrogen (wt %) | 12.80 |
| Sulfur (ppm) | 24 |
| Nitrogen (ppm) | 20 |
| Spec. Grav. | 0.8474 |
| API Grav. | 35.48 |
| Aromatic Carbon (%) | 20.20 |
| **Hydrocarbon Type** | |
| Saturates | 58.7 |
| Paraffins | 26.1 |
| Non-condensed cyclo Paraffins | 20.7 |
| Condensed Cycloparaffins, 2-rings | 7.4 |
| Condensed Cycloparaffins, 3-rings | 4.5 |
| Condensed Cycloparaffins, 4-rings | 0.0 |
| Condensed Cycloparaffins, 5-rings | 0.0 |
| Aromatics | 41.3 |
| M noaromatics (total) | 38.0 |
| Benzenes | 20.7 |
| Naphthenebenzenes | 15.7 |
| Dinaphthenebenzenes | 1.6 |
| Diaromatics (total) | 3.3 |
| Naphthalenes | 3.3 |
| Acenaphthenes, DBZfurans | 0.0 |
| Fluorenes | 0.0 |
| Triaromatics (total) | 0.0 |
| Phenanthrenes | 0.0 |
| Naphthenephenanthrenes | 0.0 |
| Tetraaromatics (total) | 0.0 |
| Pyrenes | 0.0 |
| Chrysenes | 0.0 |
| Pentaaromatics (total) | 0.0 |
| Perylenes | 0.0 |
| Dibenzanthracenes | 0.0 |
| Thiophenoaromatics (total) | 0.0 |
| Benzothiophenes | 0.0 |
| Dibenzothiophenes | 0.0 |
| Naphthobenzothiophenes | 0.0 |
| Unidentified | 0.0 |
| **GC Simulated distillation** | |
| 0.5 wt % (IBP) | 239 |
| 1.0 wt % | 262 |
| 5.0 wt % | 330 |
| 10 wt % | 360 |
| 20 wt % | 395 |
| 30 wt % | 421 |
| 40 wt % | 442 |
| 50 wt % | 458 |
| 60 wt % | 476 |
| 70 wt % | 490 |
| 80 wt % | 509 |
| 90 wt % | 525 |
| 95 wt % | 536 |
| 99 wt % | 550 |
| 99.5 wt % (FBP) | 555 |

The ordinate shows the values for the wt. % oxygen in the diesel effluent while the abscissa shows the cobalt loading in wt. % of total catalyst used in the catalyst for the applicable diesel effluent. The catalyst base used in each run depicted in FIG. 1 was MgO. More specifically the graph depicted in FIG. 1 shows that when cobalt is present in the catalyst in the preferred range of about 2 to about 20 wt. % based on the total catalyst weight, oxygen is incorporated into the diesel effluent in an amount of at least 1.8 wt. %.

Table II below shows the run conditions and product analyses for 56 runs. Runs 1 through 37, and 56 were carried out in accordance with comparative processes and Runs 38 through 55 were carried out in accordance with the process of the present invention.

TABLE II

| | Run No. | | | | |
|---|---|---|---|---|---|
| | 1 | 2 | 3 | 4 | 5 |
| Run Conditions | | | | | |
| 7% $O_2/N_2$ Flow, sccm | 400 | 400 | 400 | 400 | 400 |
| RXN Temp, ° F. | 320 | 320 | 320 | 320 | 320 |
| RXN Time, hr | 6 | 6 | 6 | 6 | 7.5 |
| Stir Rate, RPM | 300 | 300 | 300 | 300 | 900 |
| Catalyst | FeMo formaldehyde, type 1 | FeMo formaldehyde, type 2 | 5% $Cr_2O_3$ on Alumina | PtCr on $Al_2O_3$ | PtCr on $Al_2O_3$ |
| catalyst particle size, mesh | powder | powder | powder | 16/20 | 16/20 |
| Liquid product analyses | | | | | |
| Total Acid Number, mg KOH/g | 1.94 | 2.24 | 5.41 | 4.58 | 7.36 |
| Oxygen, wt % | 0.96 | 0.87 | 2.00 | 1.95 | 2.25 |

| | Run No. | | | | |
|---|---|---|---|---|---|
| | 6 | 7 | 8 | 9 | 10 |
| Run Conditions | | | | | |
| 7% $O_2/N_2$ Flow, sccm | 400 | 400 | 400 | 400 | 400 |
| RXN Temp, ° F. | 320 | 320 | 320 | 320 | 320 |
| RXN Time, hr | 7.5 | 6 | 6 | 6 | 5.5 |
| Stir Rate, RPM | 1400 | 300 | 300 | 300 | 300 |
| Catalyst | PtCr on $Al_2O_3$ | $V_2O_3$ on $Al_2O_3$ | 6% $V_2O_3$ on $Al_2O_3$ | clay-supported 24% Co | 77% Mn on $Al_2O_3$ |
| catalyst particle size, mesh | 16/20 | powder | powder | powder | powder |
| Liquid product analyses | | | | | |
| Total Acid Number, mg KOH/g | 8.68 | 3.95 | 3.50 | 3.50 | 4.31 |
| Oxygen, wt % | 2.47 | 1.91 | 1.72 | 2.02 | 2.05 |

| | Run No. | | | | |
|---|---|---|---|---|---|
| | 11 | 12 | 13 | 14 | 15 |
| Run Conditions | | | | | |
| 7% $O_2/N_2$ Flow, sccm | 400 | 400 | 1200 | 1200 | 1200 |
| RXN Temp, ° F. | 320 | 320 | 320 | 320 | 320 |
| RXN Time, hr | 5.7 | 5.5 | 1 | 2 | 3 |
| Stir Rate, RPM | 300 | 300 | 300 | 300 | 300 |
| Catalyst | Ce and La promoted $MnO_2$ on $Al_2O_3$ | 20% Co on $Al_2O_3$ | clay-supported 24% Co | clay-supported 24% Co | clay-supported 24% Co |
| catalyst particle size, mesh | powder | powder | powder | powder | powder |
| Liquid product analyses | | | | | |
| Total Acid Number, mg KOH/g | 3.79 | 4.19 | 0.58 | 1.15 | 2.09 |
| Oxygen, wt % | 1.66 | 2.05 | 0.15 | 1.01 | 1.00 |

| | Run No. | | | | |
|---|---|---|---|---|---|
| | 16 | 17 | 18 | 19 | 20 |
| Run Conditions | | | | | |
| 7% $O_2/N_2$ Flow, sccm | 1200 | 1200 | 1200 | 1200 | 1200 |
| RXN Temp, ° F. | 320 | 320 | 320 | 320 | 320 |
| RXN Time, hr | 4 | 5.5 | 1 | 2.5 | 4 |
| Stir Rate, RPM | 300 | 300 | 300 | 300 | 300 |
| Catalyst | clay-supported 24% Co | clay-supported 24% Co | clay-supported 24% Co | clay-supported 24% Co | clay-supported 24% Co |
| catalyst particle size, mesh | powder | 1/8" trilobe | 16/20 | 16/20 | 16/20 |

TABLE II-continued

| Liquid product analyses | | | | | |
|---|---|---|---|---|---|
| Total Acid Number, mg KOH/g | 2.86 | 3.97 | 0.61 | 1.99 | 3.29 |
| Oxygen, wt % | 1.21 | 1.50 | 0.45 | 0.89 | 1.50 |

| | Run No. | | | | |
|---|---|---|---|---|---|
| | 21 | 22 | 23 | 24 | 25 |
| Run Conditions | | | | | |
| 7% $O_2/N_2$ Flow, sccm | 1200 | 400 | 400 | 400 | 400 |
| RXN Temp, ° F. | 320 | 310 | 320 | 310 | 320 |
| RXN Time, hr | 6 | 4 | 4 | 4 | 6 |
| Stir Rate, RPM | 300 | 300 | 300 | 300 | 300 |
| Catalyst | clay-supported 24% Co | 20% $Cr_2O_3$ on alumina | Co—Mo promoted with mixed oxides | $Cr_2O_3$ unsupported | 8% Co on Mg silicate |
| catalyst particle size, mesh | 16/20 | powder | powder | powder | powder |
| Liquid product analyses | | | | | |
| Total Acid Number, mg KOH/g | 5.51 | 3.84 | 1.65 | 3.54 | 2.19 |
| Oxygen, wt % | 2.01 | 1.45 | 0.50 | 1.30 | 0.95 |

| | Run No. | | | | |
|---|---|---|---|---|---|
| | 26 | 27 | 28 | 29 | 30 |
| Run Conditions | | | | | |
| 7% $O_2/N_2$ Flow, sccm | 400 | 400 | 400 | 400 | 400 |
| RXN Temp, ° F. | 310 | 310 | 310 | 320 | 310 |
| RXN Time, hr | 6 | 6 | 6 | 6 | 5 |
| Stir Rate, RPM | 300 | 300 | 300 | 300 | 300 |
| Catalyst | 8% Co on $SnO_2$ | 8% Co on ZnO | 8% Co on Al 3945E alumina | Na/Beta zeolite | 8% Co on $ZrO_2$ |
| catalyst particle size, mesh | powder | powder | 1/20" extrudate | powder | 1/8" tablet |
| Liquid product analyses | | | | | |
| Total Acid Number, mg KOH/g | 4.78 | 3.86 | 4.50 | 0.03 | 5.06 |
| Oxygen, wt % | 1.47 | 1.34 | 1.41 | 0.10 | 1.86 |

| | Run No. | | | | |
|---|---|---|---|---|---|
| | 31 | 32 | 33 | 34 | 35 |
| Run Conditions | | | | | |
| 7% $O_2/N_2$ Flow, sccm | 400 | 400 | 400 | 400 | 400 |
| RXN Temp, ° F. | 310 | 310 | 310 | 310 | 310 |
| RXN Time, hr | 5 | 5 | 6 | 6 | 6 |
| Stir Rate, RPM | 300 | 300 | 300 | 300 | 300 |
| Catalyst | 8% Co on amorphous silicic acid | 24% Co on clay | 8% Co on Al-3996 alumina | 8% Co on 100% ZrC | 8% Co on $TiO_2$ |
| catalyst particle size, mesh | 1/20" extrudate | powder | v core cylinders | 1/8" extrudate | 1/8" trilobe |
| Liquid product analyses | | | | | |
| Total Acid Number, mg KOH/g | 4.35 | 3.29 | 4.86 | 5.38 | 5.87 |
| Oxygen, wt % | 1.43 | 1.75 | 1.71 | 1.68 | 1.18 |

| | Run No. | | | | |
|---|---|---|---|---|---|
| | 36 | 37 | 38 | 39 | 40 |
| Run Conditions | | | | | |
| 7% $O_2/N_2$ Flow, sccm | 400 | 400 | 400 | 400 | 1200 |
| RXN Temp, ° F. | 307 | 310 | 290 | 265 | 310 |
| RXN Time, hr | 5 | 5.5 | 5 | 1 | 1 |

TABLE II-continued

| | | | | | |
|---|---|---|---|---|---|
| Stir Rate, RPM | 900 | 300 | 1400 | 1400 | 900 |
| Catalyst | 24% Co on clay powder | 24% Co on clay powder | 8% Co on MgO powder | 8% Co on MgO powder | 8% Co on MgO powder |
| catalyst particle size, mesh | | | | | |
| Liquid product analyses | | | | | |
| Total Acid Number, mg KOH/g | 5.91 | 3.00 | 1.69 | 0.10 | 0.39 |
| Oxygen, wt % | 2.89 | 2.01 | 1.99 | 0.16 | 0.83 |

| | Run No. | | | | |
|---|---|---|---|---|---|
| | 41 | 42 | 43 | 44 | 45 |
| Run Conditions | | | | | |
| 7% $O_2/N_2$ Flow, sccm | 1200 | 1200 | 1200 | 1200 | 1200 |
| RXN Temp, ° F. | 310 | 310 | 310 | 300 | 300 |
| RXN Time, hr | 3 | 4 | 5 | 2 | 3 |
| Stir Rate, RPM | 900 | 900 | 900 | 900 | 900 |
| Catalyst | 8% Co on MgO powder | 8% Co on MgO powder | 8% Co on MgO powder | 8% Co on MgO powder | 8% Co on MgO powder |
| catalyst particle size, mesh | | | | | |
| Liquid product analyses | | | | | |
| Total Acid Number, mg KOH/g | 0.74 | 0.43 | 0.26 | 0.70 | 1.21 |
| Oxygen, wt % | 1.77 | 2.04 | 2.01 | 0.61 | 1.34 |

| | Run No. | | | | |
|---|---|---|---|---|---|
| | 46 | 47 | 48 | 49 | 50 |
| Run Conditions | | | | | |
| 7% $O_2/N_2$ Flow, sccm | 1200 | 1200 | 400 | 400 | 400 |
| RXN Temp, ° F. | 300 | 300 | 310 | 310 | 310 |
| RXN Time, hr | 4 | 5 | 6 | 5 | 5 |
| Stir Rate, RPM | 900 | 900 | 300 | 900 | 900 |
| Catalyst | 8% Co on MgO powder | 8% Co on MgO powder | 8% Co on MgO powder | 8% Co on MgO powder | 2% Co on MgO powder |
| catalyst particle size, mesh | | | | | |
| Liquid product analyses | | | | | |
| Total Acid Number, mg KOH/g | 1.44 | 0.29 | 1.20 | 1.08 | 1.47 |
| Oxygen, wt % | 1.99 | 1.74 | 1.24 | 2.26 | 1.82 |

| | Run No. | | | | | |
|---|---|---|---|---|---|---|
| | 51 | 52 | 53 | 54 | 55 | 56 |
| Run Conditions | | | | | | |
| 7% $O_2/N_2$ Flow, sccm | 400 | 400 | 400 | 400 | 400 | 1210 |
| RXN Temp, ° F. | 310 | 310 | 310 | 310 | 310 | 310 |
| RXN Time, hr | 5 | 5 | 5 | 5 | 5 | 5 |
| Stir Rate, RPM | 900 | 900 | 900 | 900 | 300 | 900 |
| Catalyst | 4% Co on MgO | 12% Co on MgO | 8% Co on MgO | 20% Co on MgO | 50% Co/50% MgO, calcined in air | MgO |
| catalyst particle size, mesh | powder | powder | powder | powder | powder | powder |
| Liquid product analyses | | | | | | |
| Total Acid Number, mg KOH/g | 1.51 | 1.51 | 1.43 | 1.34 | 0.62 | 1.98 |
| Oxygen, wt % | 2.04 | 1.92 | 2.18 | 1.98 | 0.98 | 2.05 |

EXAMPLE 2

Figure 2:
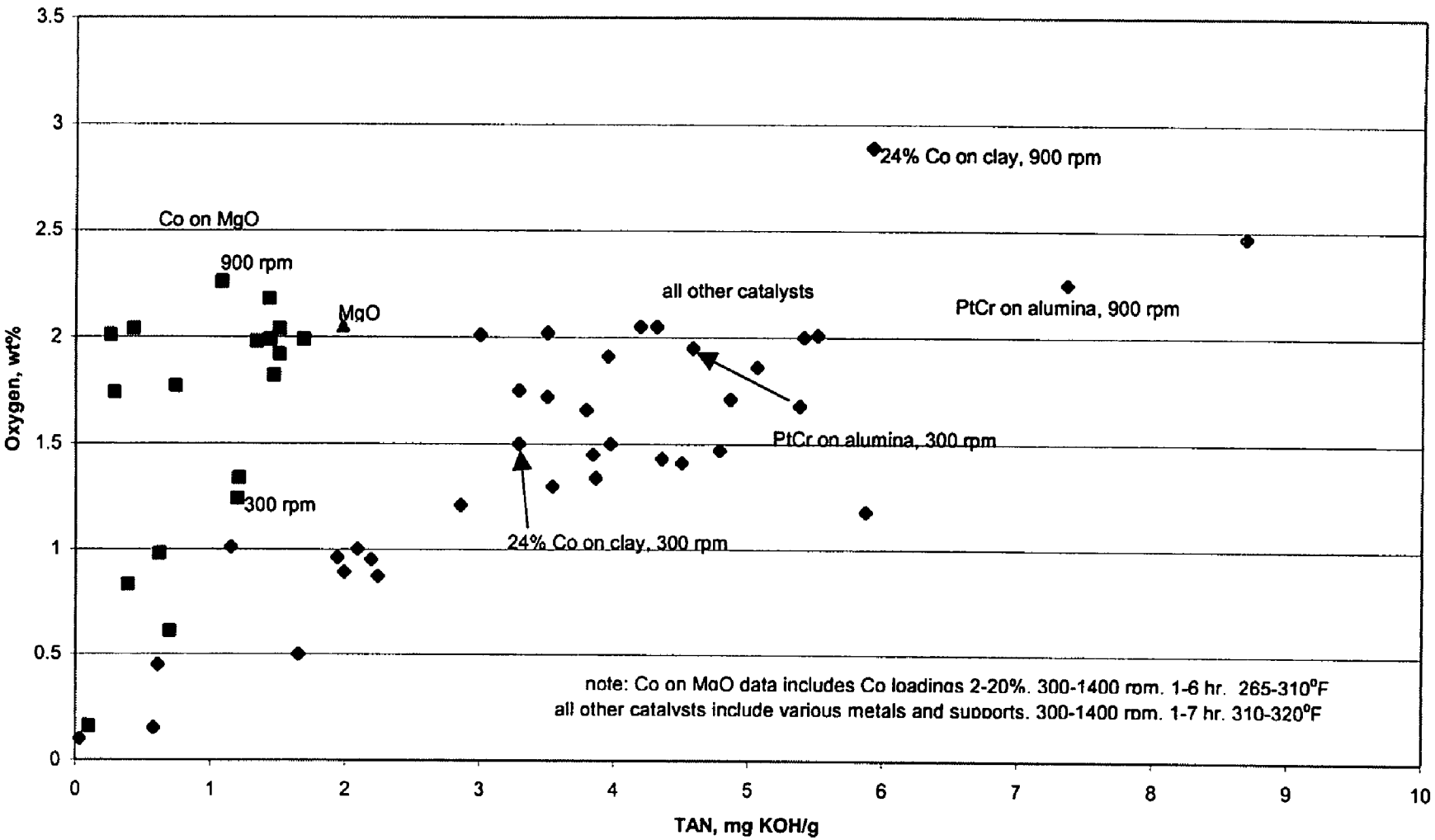
FIG. 2 is a graph that shows the favorable oxygen content and total acid number achieved by a process carried out in accordance with the present invention versus other comparative processes.

FIG. 2 graphically depicts the results set forth in Table II and shows a comparison of results obtained using the preferred catalyst systems in accordance with the present invention ("Co supported on MgO" shown as squares) with comparative results generated using a range of catalysts that lie outside the scope of the present invention. Data points for these comparative runs are shown as diamonds in the figure. The ordinate shows wt. % oxygen in the diesel effluent while the abscissa shows the TAN value for the applicable diesel effluent. The Co on MgO samples were tested over a range of conditions. All runs in this example were otherwise carried out with the same equipment, same feed described in Example 1, and oxidation conditions as set forth in Table II. The graph clearly demonstrates that selective oxygenation is achieved by the process of the present invention with the desirable concomitant low levels of TAN, typically lower than 2 mg KOH/g. Further, as the RPM of the autoclave is increased, the oxygen "circulation" rate is increased. For the process in accordance with the present invention as the oxygen circulation rate is increased, the oxygen incorporation into the diesel effluent increases without an undesirable increase in TAN number of the effluent. Note that for the comparative runs using a PtCr on alumina catalyst, as the RPM was increased, the TAN number as well as oxygen incorporation went up.

EXAMPLE 3

Figure 3:
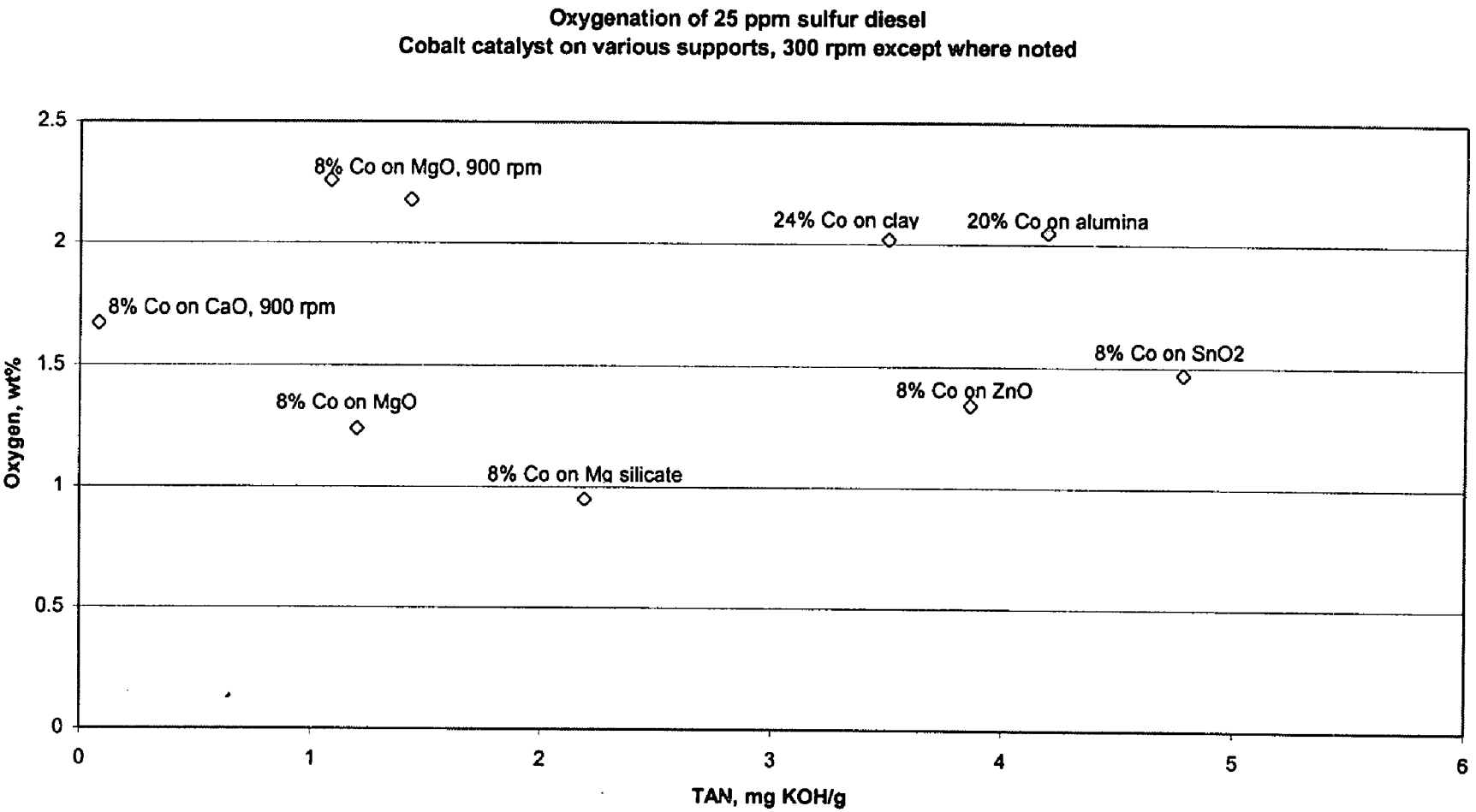
FIG. 3 is another graph that shows the favorable oxygen content and total acid number achieved by a process carried out in accordance with the present invention versus comparative processes wherein the catalyst base is varied.

FIG. 3 shows selected results obtained where the process of the present invention using a catalyst comprising cobalt on basic supports, e.g. CaO and MgO is compared with comparative processes using catalysts wherein cobalt is supported on non-basic supports, i.e. Mg silicate, clay, alumina, $SnO_2$, ZnO. Again the ordinate shows wt. % oxygen while the abscissa show the TAN value for the diesel effluent. The data clearly shows that the desirable results in the effluent distillate of low TAN coupled with high oxygen incorporation into the effluent are achieved when the process of the present invention using a Group VIII metal on a basic support is used. While not wishing to be bound by theory it is believed that the use of basic supports such as MgO and CaO in accordance with the invention suppress TAN formation. The feedstock and equipment used in the present example are described in Example 1. The oxidation conditions for the applicable runs are set forth in Table II.

That which is claimed is:

1. A process for selectively oxygenating a distillate feedstock which process comprises contacting said feedstock with an oxygen-containing gas in an oxidation zone at oxidation conditions comprising elevated temperatures in a range from about 200 degrees F. to about 450 degrees F. in the presence of solid oxidation catalyst comprising a cobalt containing component in an amount ranging from 2 to 20 percent by weight based on the total weight of the catalyst and a basic support comprising a member of the group consisting of calcium oxide and magnesium oxide, and recovering an effluent stream distillate having an oxygen content incorporated therein in a range of 0.2 to 20 percent by weight and a TAN number of less than 2 mg KOH/g.

2. The process of claim 1 wherein the basic support comprises magnesium oxide.

3. The process of claim 1 wherein the basic support comprises calcium oxide.

4. A process for selectively oxygenating a distillate feedstock which process comprises contacting said feedstock with an oxygen-containing gas in an oxidation zone at oxidation conditions comprising elevated temperatures in a range from about 250 degrees F. to about 350 derees F. in the presence of solid oxidation catalyst comprising cobalt in an amount ranging from 4 to 12 percent by weight based on the total weight of the catalyst and magnesium oxide, and recovering an effluent stream distillate having an oxygen content incorporated therein of about 1.8 to about 10 percent by weight and a TAN number less than about 1 mg KOH/g.

* * * * *